US007633475B2

(12) United States Patent
Park

(10) Patent No.: US 7,633,475 B2
(45) Date of Patent: Dec. 15, 2009

(54) METHOD, COMPUTER READABLE MEDIUM USING THE SAME AND DEVICE FOR PERFORMING THE SAME

(75) Inventor: Bong-Im Park, Asan (KR)

(73) Assignee: Samsung Electronics Co., Ltd. (KR)

( * ) Notice: Subject to any disclaimer, the term of this patent is extended or adjusted under 35 U.S.C. 154(b) by 890 days.

(21) Appl. No.: 11/219,068

(22) Filed: Sep. 2, 2005

(65) Prior Publication Data

US 2006/0061828 A1 Mar. 23, 2006

(30) Foreign Application Priority Data

Sep. 23, 2004 (KR) ..... 10-2004-0076692

(51) Int. Cl.
*G09G 3/36* (2006.01)

(52) U.S. Cl. ..... 345/89; 345/90; 345/98; 345/99; 345/100

(58) Field of Classification Search ..... 345/87–100, 345/204–215, 690
See application file for complete search history.

(56) References Cited

U.S. PATENT DOCUMENTS

2007/0285712 A1* 12/2007 Komada ..... 358/1.15
2008/0114247 A1* 5/2008 Urbano et al. ..... 600/447
2008/0114248 A1* 5/2008 Urbano et al. ..... 600/447

* cited by examiner

*Primary Examiner*—Vijay Shankar
(74) *Attorney, Agent, or Firm*—Cantor Colburn LLP

(57) ABSTRACT

In an interpolation method for generating an objective interpolation value in a look up table including a plurality of position data that are stored in a plurality of regions defined by a plurality of rows and a plurality of columns, at least three first position data in one of the columns of the look up table are extracted. At least two second position data in one of the rows of the look up table are extracted. The objective interpolation value is generated using the first position data and the second position data. Therefore, the size of the memory may be decreased while the accuracy is improved.

34 Claims, 8 Drawing Sheets

METHOD, COMPUTER READABLE MEDIUM USING THE SAME AND DEVICE FOR PERFORMING THE SAME

This application claims priority to Korean Patent Application No. 2004-76692 filed on Sep. 23, 2004, the contents of which in its entirety are herein incorporated by reference in its entirety.

BACKGROUND OF THE INVENTION

1. Field of the Invention

The present invention relates to an interpolation method. More particularly, the present invention relates to an interpolation method, a computer readable medium using the interpolation method, a device for performing the interpolation method, a display device incorporating the device for performing the interpolation method, a driving apparatus for the display device and a method of driving the display device.

2. Description of the Related Art

Flat panel display devices, such as a plasma display panel (PDP) device, a liquid crystal display (LCD) device, etc., have been recently developed. In comparing PDP devices to LCD devices, it is generally accepted that the viewing angle, the response speed and the image display quality of a moving picture of a thin film transistor liquid crystal display (TFT-LCD) device has been improved so that the TFT-LCD device has better characteristics than the PDP device in a television receiver set.

In order to further improve the response speed of liquid crystals, a method of using high speed liquid crystals, a method of altering a structure of a TFT cell and an over-driving method have been developed in the TFT-LCD device. In particular, the over-driving method includes a dynamic capacitance compensation (DCC) method.

In the DCC method, a frame gray-scale data of a previous frame undergo overshooting or undershooting after comparing the gray-scale data of the previous frame and gray-scale data of the present frame, thereby improving the response speed of the liquid crystals.

The liquid crystals have various physical characteristics so that an amount of the over-driving of the gray-scales is difficult to determine using a linear equation. In order to determine the amount of the over-driving of the g ray-scales using the linear equation, the over-driving circuit has a look up table (LUT) storing the amount of the over-driving. In general, the amount of the over-driving stored in the LUT is determined based on a vertical frequency of sixty hertz at room temperature.

However, when the temperature of the liquid crystals and the vertical frequency is varied, an objective value of the response speed of the liquid crystals is also changed so that the objective value is different from the amount of the over-driving stored in the LUT.

The amount of the over-driving is substantially in inverse proportion to the temperature and the vertical frequency. That is, when the temperature is increased, the amount of the over-driving is decreased so as to compensate for the response speed. To the contrary, when the temperature is decreased, the amount of the over-driving is decreased. In addition, when the vertical frequency is decreased, the amount of the over-driving is increased so as to compensate for the response speed.

In order to render the response speed of the liquid crystals uniform, the temperature is sensed by an external temperature sensor or an internal temperature sensor, and a timing control part selects a LUT optimized to the temperature.

However, when LUTs optimized in accordance with temperature are stored in an inner memory of the timing control part, the size of the associated chip is increased, and heat generated from the timing control part and capacity of the external memory are increased.

BRIEF SUMMARY OF THE INVENTION

The present invention provides an interpolating method capable of reducing a memory size and improving accuracy.

The present invention also provides a computer readable medium using the above-mentioned interpolation method.

The present invention also provides a device performing the above-mentioned interpolation method.

The present invention also provides a display device using the above-mentioned interpolation method.

The present invention also provides a driving device for the above-mentioned display device.

The present invention also provides a method of driving the above-mentioned driving device using the above-mentioned interpolation method.

In an exemplary embodiment, an interpolation method for generating an objective interpolation value in a look up table including a plurality of position data that are stored in a plurality of regions defined by a plurality of rows and a plurality of columns is provided as follows. At least three first position data in one of the columns of the look up table are extracted. At least two second position data in one of the rows of the look up table are extracted. The objective interpolation value is generated using the first position data and the second position data.

In another exemplary embodiment, an interpolation method to generate an objective interpolation value in a look up table including a plurality of position data that are stored in a plurality of regions defined by a plurality of rows and a plurality of columns is provided as follows. A first interpolation value on a first line connecting at least three position data in one of the columns of the look up table is calculated. A second interpolation value on a second line connecting at least three position data in another column of the look up table is calculated. The lo second line is adjacent to the first line. A difference value between a column component of the first line and a column component of the objective interpolation value is generated. The difference value is divided by a difference between gray-scale levels in adjacent columns to generate a division value. A difference between the first and second interpolation values is multiplied by the division value to generate a multiplied value. The first interpolation value is added to the multiplied value to generate the objective interpolation value.

In still another exemplary embodiment, a computer readable medium performs an interpolation method to generate an objective interpolation value in a look up table including a plurality of position data that are stored in a plurality of regions defined by a plurality of rows and a plurality of columns. The computer readable medium includes a program. In a method of processing the program, a first interpolation value on a first line connecting at least three position data in one column of the look up table is calculated. A second interpolation value on a second line connecting at least three position data in another column of the look up table is calculated. The second line is adjacent to the first line. A difference value between a column component of the first line and a column component of the objective interpolation value is generated. The difference value is divided by a difference between gray-scale levels in adjacent columns to generate a division value. A difference between the first and second interpolation values is multiplied by the division value to generate a multiplied value. The first interpolation value is added to the multiplied value to generate the objective interpolation value.

In still another exemplary embodiment, a device generates an objective interpolation value in a look up table including a plurality of position data that are stored in a plurality of regions defined by a plurality of rows and a plurality of columns. The device includes an extracting part and a generating part. The extracting part extracts at least three first position data in one of the columns of the look up table and at least two second position data in one of the rows of the look up table. The generating part generates the objective interpolation value using the first position data and the second position data.

In still another exemplary embodiment, a device generates an objective interpolation value in a look up table including a plurality of position data that are stored in a plurality of regions defined by a plurality of rows and a plurality of columns. The device includes a calculating part, a subtracting part, a dividing part, a multiplying part and an adding part. The calculating part calculates a first interpolation value disposed on a first line to connect at least three position data in one of the columns of the look up table and a second interpolation value on a second line to connect at least three position data in another column of the look up table. The second line is adjacent to the first line. The subtracting part generates a difference value between a column component of the first line and a column component of the objective interpolation value. The dividing part divides the difference value by a distance between gray-scale levels in adjacent columns to generate a division value. The multiplying part multiplies a difference between the first and second interpolation values by the division value to generate a multiplied value. The adding part adds the first interpolation value to the multiplied value to generate the objective interpolation value.

In still another exemplary embodiment, a device generates an objective interpolation value in a look up table including a plurality of position data that are stored in a plurality of regions defined by a plurality of rows and a plurality of columns. The device includes a first multiplying part, a second multiplying part and an adding part.

The first multiplying part multiplies a square value of a column component of the objective interpolation value by an operating value to generate a first multiplied value. The operating value is $$\left[\left(1-\frac{\Delta y}{\Delta}\right)p1+\frac{\Delta y}{\Delta}p1'\right],\ \left[\left(1-\frac{\Delta y}{\Delta}\right)p2+\frac{\Delta y}{\Delta}p2'\right]\ \text{or}$$
$$\left[\left(1-\frac{\Delta y}{\Delta}\right)p3+\frac{\Delta y}{\Delta}p3'\right],$$

wherein $\Delta y$ and $\Delta$ represent a distance between a first interpolation value of a first row and the objective interpolation value and a distance between gray-scales of a first column and a second column, respectively, p1, p2 and p3 represent coefficients corresponding to the first column, and p1', p2' and p3' represent coefficients corresponding to the second column. The second multiplying part multiplies the column component by the operating value to generate a second multiplied value. The adding part sums up the first multiplied value, the second multiplied value and the operating value to generate the objective interpolation value.

In still another exemplary embodiment, a display device includes a liquid crystal display part, a look up table and a control part. The LCD part displays an image using liquid crystals. The look up table includes a plurality of columns corresponding to an image signal of a previous frame and a plurality of rows corresponding to an image signal of a present frame. The controlling part provides the liquid crystal display part with compensation gray-scale data extracted from the look up table based on the image signal of the previous frame and the image signal of the present frame. The controlling part interpolates a column component via a quadratic equation and a row component via a linear equation to provide the liquid crystal display part with the compensation gray-scale data, when the look up table does not have gray-scale data of the image signal of the previous frame or the image signal of the present frame.

In still another exemplary embodiment, a driving apparatus for a display device provides a liquid crystal display part displaying an image using liquid crystal with an image signal. The driving apparatus includes a look up table and a controlling part. The look up table includes a plurality of columns corresponding to an image signal of a previous frame and a plurality of rows corresponding to an image signal of a present frame. The controlling part provides the liquid crystal display part with a compensation gray-scale data extracted from the look up table based on the image signal of the previous frame and the image signal of the present frame. The controlling part interpolates a column component via a quadratic equation and a row component via a linear equation to provide the liquid crystal display part with the compensation gray-scale data, when the look up table does not have gray-scale of the image signal of the previous frame or the image signal of the present frame.

In still another exemplary embodiment, a method of driving a display device is provided as follows. The display device includes a plurality of gate lines, a plurality of data lines and a plurality of switching elements formed in a region defined by the gate lines and the data lines. The data lines cross the gate lines, and are electrically insulated from the gate lines. The switching elements are electrically connected to the gate lines and the data lines. The gate signals are sequentially applied to the gate lines. Compensation gray-scale data are outputted from a look up table based on an image signal of the previous frame and an image signal of the present frame. The compensation gray-scale data are outputted by outputting the compensation gray-scale data stored in the look up table, when the look up table has gray-scale data of the image signal of the previous frame and the image signal of the present frame, and interpolating a column component via a quadratic equation and interpolating a row component via a linear equation to output the compensation gray-scale data, when the look up table does not have gray-scale data of the image signal of the previous frame or the image signal of the present frame. The data voltages corresponding to the compensation gray-scale data are applied to the data lines.

According to the present invention, although the image signal of the previous frame and the image signal of the present frame are not in the look up table, the column and row components of the compensation gray-scale data are interpolated via the quadratic equation and the linear equation, respectively, thereby decreasing the size of the associated memory and improving overall accuracy.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF THE INVENTION

Figure 1:
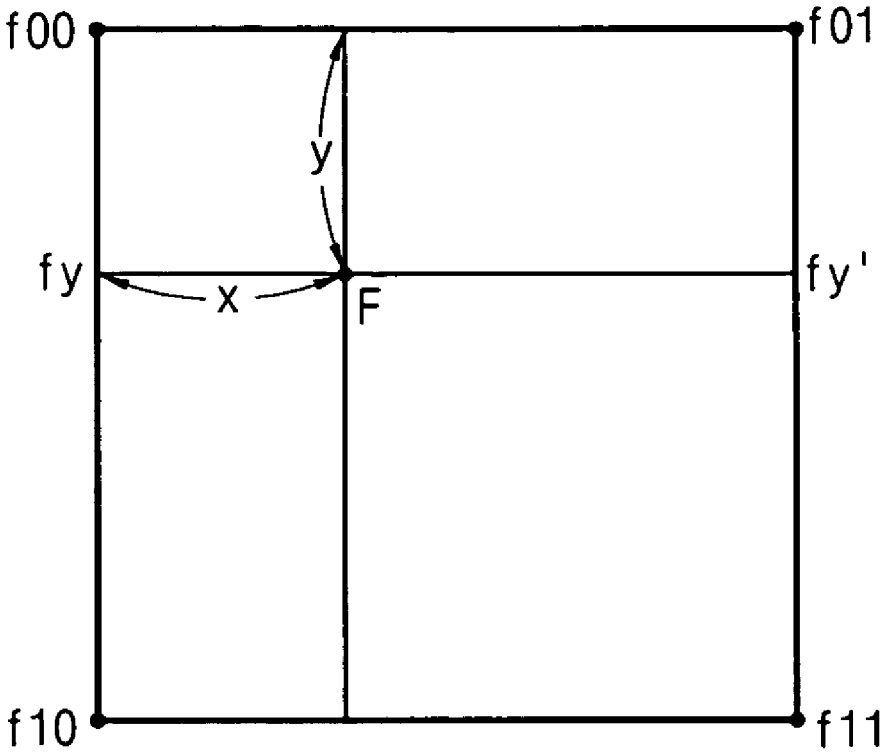
FIG. 1 is a graph showing a bi-linear interpolation algorithm.

The invention now will be described more fully hereinafter with reference to the accompanying drawings, in which exemplary embodiments of the invention are shown. This invention may, however, be embodied in many different forms and should not be construed as limited to the embodiments set forth herein. Rather, these exemplary embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present. In contrast, when an element is referred to as being "directly on" another element, there are no intervening elements present. As used herein, the term "and/or" includes any and all combinations of one or more of the associated listed items.

It will be understood that, although the terms first, second, etc. may be used herein to describe various elements, these elements should not be limited by these terms. These terms are only used to distinguish one element from another. For example, a first thin film could be termed a second thin film, and, similarly, a second thin film could be termed a first thin film without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

In order to increase the response speed of liquid crystals, a liquid crystal display (LCD) device is operated using a dynamic capacitance compensation (DCC) method. In the DCC method, a high voltage or a low voltage is applied between a gray-scale data Gn-1 of a previous frame and a gray-scale data Gn of a present frame so that the liquid crystals are operated in one frame.

The LCD device of the DCC method includes an application specific integrated circuit (ASIC) and a memory of a predetermined capacity. For example, the LCD device of the DCC method has a seventeen by seventeen look up table (LUT) or nine by nine LUT. Values between 256*256 gray-scale data are determined through a bi-linear interpolation.

FIG. 1 is a graph showing a bi-linear interpolation algorithm.

Referring to FIG. 1, two mono-linear interpolation algorithms are combined to form the bi-linear interpolation algorithm.

A first interpolation position data f00, a second interpolation position data f10, a third interpolation position data f01 and a fourth interpolation position data f11 define four corners of a rectangular shape. An objective interpolation value F is determined based on the first, second, third and fourth interpolation position data f00, f10, f01 and f11. That is, Equation 1 (below) determines a first column component fy of the objective interpolation value F, and Equation 2 (below) determines a second column component fy' of the objective interpolation value F.

$$fy=f00+y(f10-f00) \quad \text{Equation 1}$$

In Equation 1, fy, f00, y and f10 represent the first column component, the first interpolation position data, an interval between gray-scale levels in a column direction and the second interpolation position data, respectively.

$$fy'=f01+y(f11-f01) \quad \text{Equation 2}$$

In Equation 2, fy', f01, y and f11 represent the second column component, the third interpolation position data, the interval between gray-scale levels in the column direction and the fourth interpolation position data, respectively.

Equation 3 determines the objective interpolation value based on the first column component fy and the second column component fy'.

$$\begin{aligned} F &= fy - x(fy - fy') \quad \text{Equation 3} \\ &= f00 + (f01 - f00)x + (f10 - f00)y + \\ &\quad (f00 + f11 - f01 - f10)xy \\ &= f00 + ax + by + cxy \end{aligned}$$

In Equation 3, 'a', 'b' and 'c' represent f01-f00, f10-f00 and f00+f11−f01−f10, respectively.

The response speed of the liquid crystals has a non-linear behavior so that the objective interpolation value determined by the bi-linear interpolation algorithm has an error.

Figure 2:
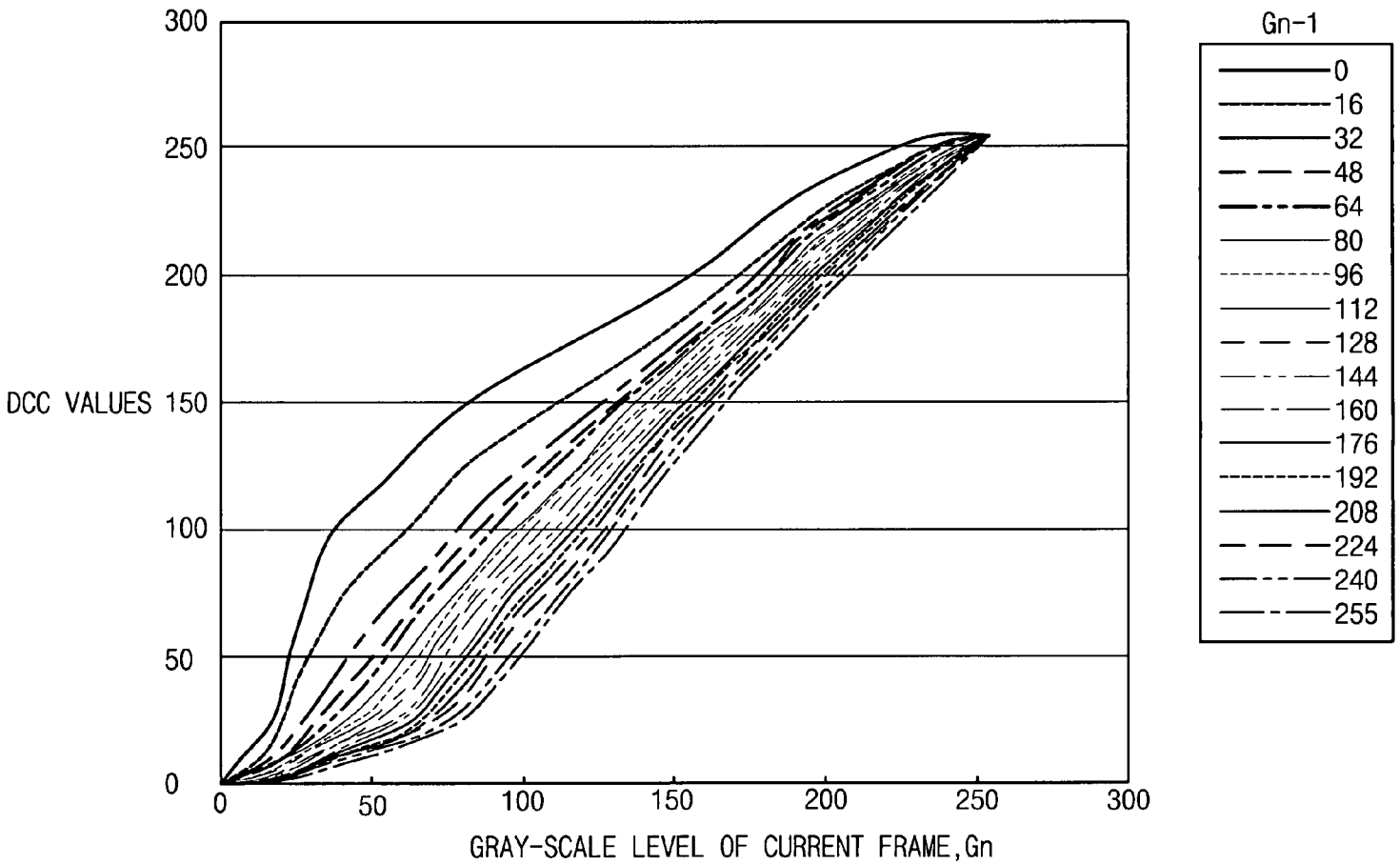
FIG. 2 is a graph showing a relationship between a DCC value and a gray-scale level of a current frame.
Figure 3:
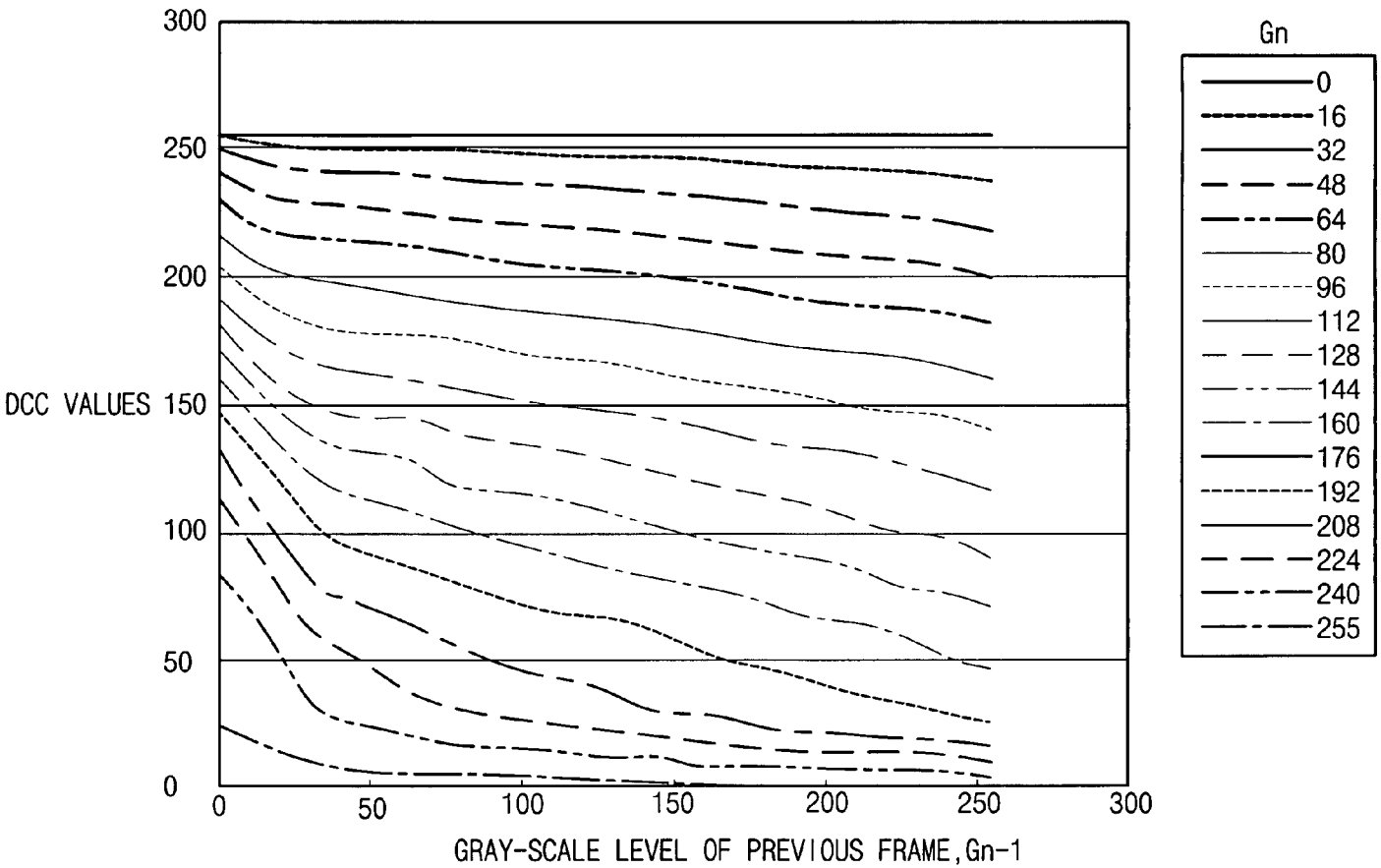
FIG. 3 is a graph showing a relationship between a DCC value and a gray-scale level of a previous frame at room temperature.

FIG. 2 is a graph showing a relationship between DCC values and a gray-scale level of a current frame with respect to a gray-scale level of a previous frame at room temperature. FIG. 3 is a graph showing a relationship between DCC values and the gray-scale level of the previous frame with respect to the gray-scale level of the present frame.

In the DCC method, various environmental data are digitized to compensate for the response speed of the liquid crystals. Examples of the environmental data include temperature, moisture, etc. For example, the environmental data are stored in a DCC look-up table (LUT) that has compensation gray-scale data to increase the response speed of the liquid crystals, and a LUT corresponding to a temperature of an LCD panel is outputted from the DCC LUT to operate the LCD device.

The size of the DCC LUT and the number of the DCC LUT constitute a trade off in the accuracy of an objective interpolation value. When the capacity of an external memory is fixed, the size of the LUT is decreased to increase the accuracy of the objective interpolation value.

In the bi-linear interpolation algorithm, when the size of the LUT is decreased, an interval between sampling values is increased to increase an error of the objective interpolation value. In particular, in order to compensate for the environmental data, an application specific integrated circuit (ASIC) is integrated such that a dimension of the interpolation algorithm is increased.

Referring to FIGS. 2 and 3, the data stored in the LUT displays the non-linear behavior.

Hereinafter, a DCC method for increasing accuracy and reproducibility is described in response to the non-linear behavior of the data stored in the LUT shown in FIGS. 2 and 3. In particular, when an image is displayed using the DCC method (or an overshooting method), an objective interpolation value that is not stored in the LUT is determined by an interpolation. That is, a new gray-scale data is determined through the interpolation. The interpolation is a quasi-bi-quadratic interpolation.

Figure 4:
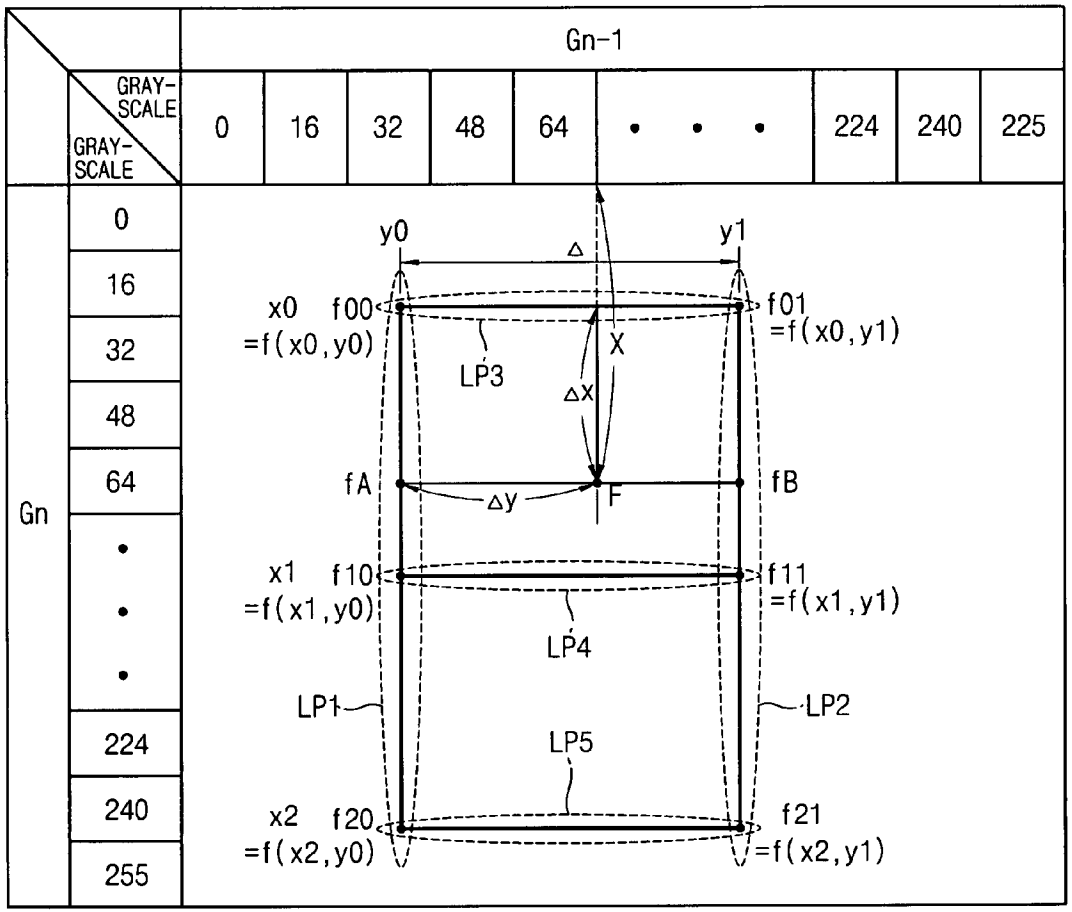
FIG. 4 is a graph showing a quasi-bi-quadratic interpolation algorithm in accordance with an exemplary embodiment of the present invention.

FIG. 4 is a graph showing a quasi-bi-quadratic interpolation algorithm in accordance with one embodiment of the present invention.

Referring to FIG. 4, the quasi-bi-quadratic interpolation is performed using a first position data f00, a second position data f10, a third position data f20, a fourth position data f01, a fifth position data f11 and a sixth position data f21.

In particular, a quadratic interpolation is performed using a linear least square approximation based on the first, second and third position data f00, f10 and f20 that are grouped into a first loop LP1 in a column direction (or a longitudinal direction) and the fourth, fifth and sixth position data f01, f11 and f21 that are grouped into a second loop LP2 in the column direction. That is, the quadratic interpolation is performed using the first and second loops LP1 and LP2. Each of the first and second loops LP1 and LP2 include the three position data.

In addition, a linear interpolation is performed based on the first and fourth position data f00 and f01 that are grouped into a third loop LP3 in a row direction, the second and fifth position data f10 and f11 that are grouped into a fourth loop LP4 in the row direction, and the third and sixth position data f20 and f21 that are grouped into a fifth loop LP5 in the row direction. That is, the linear interpolation is performed using the third, fourth and fifth loops LP3, LP4 and LP5. Each of the third, fourth and fifth loops LP3, LP4 and LP5 has the two position data.

The interpolation may be performed, even though an interval Δ between gray-scales in the column direction is not constant.

In FIG. 4, the interpolation is performed based on the first, second, third, fourth, fifth and sixth position data f00, f10, f20, f01, f11 and f21 that form the two by three matrix. Alternatively, the interpolation may be performed based on nine position data that form three by three matrixes.

Referring to FIG. 4, the first, second and third position data f00, f10 and f20 (or x0, x1 and x2) are grouped into the first loop LP1.

The third position data x2 is substantially equal to the second position data x1 plus Δy. In addition, the third position data x2 is substantially equal to the first position data x0 plus 2*Δy. Equation 4 (below) is a Taylor series of the third position data x2 (x2≅x1+Δy≅x0+(2×Δy)).

$$f(x) = f(x1) + (x - x1) \times f'(x1) + \left(\frac{(x-x1)^2}{2}\right) \times f''(x1) + \left(\frac{(x-x1)^3}{3!}\right) \times f'''(x1) + \ldots \quad \text{Equation 4}$$

In Equation 4, derivative functions f'''(x), f''''(x), . . . ) more than third order are negligible. Equation 7 (below) that determines f(x) is derived from Equation 4, Equation 5 and Equation 6 (below).

$$f'(x1) = \frac{[f(x2) - f(x1)]}{\Delta x} \quad \text{Equation 5}$$

$$f''(x1) = \frac{[f(x2) - 2f(x1) + f(x0)]}{\Delta x^2} \quad \text{Equation 6}$$

$$f(x) = a + bx + cx^2 \quad \text{Equation 7}$$

$$a = \frac{1}{\Delta x2} \times \left[\left(\frac{1}{2}x12 - x1\Delta x\right)f(x2) + (-x12 + x1 \times \Delta x + \Delta x2)f(x1) + \frac{1}{2}x12f(x0)\right]$$

$$b = \frac{1}{\Delta x2} \times [-x0f(x2) + x2f(x1) + x1f(x0)]$$

-continued $$c = \frac{1}{(2 \times \Delta x2)} \times [f(x2) - 2f(x1) - f(x0)]$$

Equation 7 is an approximate expression at x=x1 so that an error is formed at x=x0 or x=x2. That is, in the DCC method, the data stored in the LUT has the 20 non-linear behavior and thus is actually inappropriate for DCC LUT.

Equation 8 (below) is a quadratic equation that is obtained using a linear least square approximation so as to decrease the error.

$$AX=B \qquad \text{Equation 8}$$

'A' represents a matrix of Equation 9 (below). 'B' represents a matrix of Equation 10 (below). 'X' represents a matrix of Equation 11 (below).

$$A = \begin{bmatrix} x0^2 x01 \\ x1^2 x11 \\ x2^2 x21 \end{bmatrix} \qquad \text{Equation 9}$$

$$B = \begin{bmatrix} f00 \\ f10 \\ f20 \end{bmatrix} \qquad \text{Equation 10}$$

$$X = \begin{bmatrix} p1 \\ p2 \\ p3 \end{bmatrix} \qquad \text{Equation 11}$$

In the above Equation 11, p1, p2 and p3 represent coefficients of the first loop LP1.

'X' is determined by Equation 12 (below).

$$X=A^{-1}B \qquad \text{Equation 12}$$

Equation 13 (below) determines the coefficients of the first loop LP1 based on Equations 9, 10 and 11.

$$\begin{bmatrix} p1 \\ p2 \\ p3 \end{bmatrix} = \begin{bmatrix} x0^2 x01 \\ x1^2 x11 \\ x2^2 x21 \end{bmatrix}^{-1} \begin{bmatrix} f00 \\ f10 \\ f20 \end{bmatrix} \qquad \text{Equation 13}$$

Equation 14 (below) represents a quadratic equation covering the first, second and third position data x0, x1 and x2 (or f00, f10 and f20) that are grouped into the first loop LP1.

$$f(x)=p1x^2+p2x+p3 \qquad \text{Equation 14}$$

Equation 15 (below) determines a first interpolation value $f_A$ in the column direction based on the first, second and third position data x0, x1 and x2 (or f00, f10 and f20) that are grouped into the first loop LP1.

$$f_A=p1(x0+\Delta x)^{2-}-p2(x0-\Delta x)+p3 \qquad \text{Equation 15}$$

In Equation 15, x0 and Δx are the first position data of the first loop LP1, and a difference between the first interpolation value $f_A$ and the objective interpolation value, respectively. In Equation 15, p1, p2 and p3 represent the coefficients of the first loop LP1.

Equation 16 (below) represents the quadratic equation covering the fourth, fifth and sixth position data x0, x1 and x2 (or f01, f11 and f21) that are grouped into the second loop LP2.

$$f(x)=p1'x^2+p2'x+p3' \qquad \text{Equation 16}$$

In Equation 16, p1', p2'and p3' represent the coefficients of the second loop LP2.

Equation 17 (below) determines a second interpolation value $f_B$ in the column direction based on the fourth, fifth and sixth position data x0, x1 and x2 (or f01, f11 and f21) that are grouped into the second loop LP2.

$$f_B=p1'(x0+\Delta x)^2+p2'(x0+\Delta x)+p3 \qquad \text{Equation 17}$$

In Equation 17, x0 and Δx are the fourth position data of the first loop LP2, and a difference between the second interpolation value $f_B$ and the objective interpolation value, respectively. In Equation 17, p1', p2' and p3' represent the coefficients of the second loop LP2.

Equations 18 and 19 (below) determine X' and B', respectively.

$$X' = \begin{bmatrix} p1' \\ p2' \\ p3' \end{bmatrix} = A^{-1}B' \qquad \text{Equation 18}$$

$$B' = \begin{bmatrix} f01 \\ f11 \\ f21 \end{bmatrix} \qquad \text{Equation 19}$$

Equations 15 and 17 are the quadratic equations that determine the first interpolation value $f_A$ and the second interpolation value $f_B$ to decrease the error, although the position data have the non-linear behavior.

Referring to FIG. 2, the gray-scale data of the present frame have the non-linear behavior in the column direction of the DCC LUT. However, referring to FIG. 3, the gray-scale data of the previous frame have a substantially linear behavior in the row direction of the DCC LUT. Therefore, the row component of the gray-scale data may be approximated by a linear equation. Equation 20 (below) interpolates the first interpolation value $f_A$ in the column direction and the second interpolation value $f_B$ in the column direction through the linear interpolation.

$$\Delta:\Delta y=(f_B-f_A):(F-f_A) \qquad \text{Equation 20}$$

In Equation 20, F, $f_A$, $f_B$, Δ and Δy represent the objective interpolation value, the first interpolation value in the column direction, the second interpolation value in the column direction, a difference between gray-scale levels of adjacent columns and a difference between the first interpolation value in the column direction and the objective interpolation value, respectively.

Equation 21 (below) is derived from Equation 20.

$$F = f_A + \frac{\Delta y}{\Delta}(f_B - f_A) \qquad \text{Equation 21}$$

In Equation 21, F, $f_A$, $f_B$, Δ and Δy represent the objective interpolation value, the first interpolation value in the column direction, the second interpolation value in the column direction, the difference between the gray-scale levels of adjacent columns and the difference between the first interpolation value in the column direction and the objective interpolation value, respectively.

The difference Δ between gray-scale levels of adjacent columns varies in response to characteristics of the liquid crystals. For example, when an inclination of the gray-scale data Gn-1 of the previous frame is steep, the difference Δ is decreased. The steep inclination corresponds to gray-scales of 0, 16, 48, 112 and 255. In addition, when the inclination of the gray-scale data Gn-1 of the previous frame is relatively small, the difference Δ is increased. Therefore, the size of the LUT in the column direction is decreased, and the error is decreased.

Equation 22 (below) is derived from Equation 21 based on Equations 15 and 17.

$$F = \left[\left(1 - \frac{\Delta y}{\Delta}\right)p1 + \frac{\Delta y}{\Delta}p1'\right] X^2 + \left[\left(1 - \frac{\Delta y}{\Delta}\right)p2 + \frac{\Delta y}{\Delta}p2'\right]X + \left[\left(1 - \frac{\Delta y}{\Delta}\right)p3 - \frac{\Delta y}{\Delta}p3'\right] \quad \text{Equation 22}$$

In Equation 22, Δy, Δ and X represent the difference between the first interpolation value in the row direction and the objective interpolation value, the difference between gray-scales of the first column and gray-scales in the second column, and column components of the objective interpolation value, respectively. p1, p2 and p3 represent coefficients of the first column. p1', p2' and p3' represent coefficients of the second column.

The difference Δ between gray-scales of the first column and gray-scales in the second column may be changed as required.

In order to perform the DCC interpolation, the four coefficients f00, a, b and c of Equation 3 are stored in a synchronous dynamic random access memory (SDRAM) to simplify calculation. For example, an exemplary size of the LUT for storing f00, a, b and c is seventeen by seventeen and elements stored in the LUT is 6144 (16*16*24) bits. The twenty four bits are summation of eight bits of f00 and sixteen bits of a, b and c.

The three coefficients p1, p2 and p3 of Equation 11 that comprise the quadratic equation are stored to perform the DCC interpolation. For example, when a size of the LUT for storing p1, p2 and p3 is eight by thirteen, elements stored in the LUT is 3465 (7*11*45) bits. The forty five bits are the summation of p1, p2 and p3.

Therefore, it will be appreciated from the foregoing discussion that the number of the elements stored in the LUT is decreased to decrease the size of the memory.

When Δx and Δy are determined, the DCC value are calculated using Equations 14, 16 and 19 so that the object interpolation value F is determined by the DCC value.

When the difference between the gray-scale levels in the column direction is changed, the LUT has various shapes such as a square arrangement, a rectangular arrangement, etc. The square arrangement includes, for example, a sixteen by sixteen matrix, a nine by nine matrix, etc. The rectangular arrangement includes, for example, an eight by thirteen matrix. When the LUT has a rectangular arrangement, the LCD device is operated through the DCC method, and the size of the memory is decreased.

Figure 5:
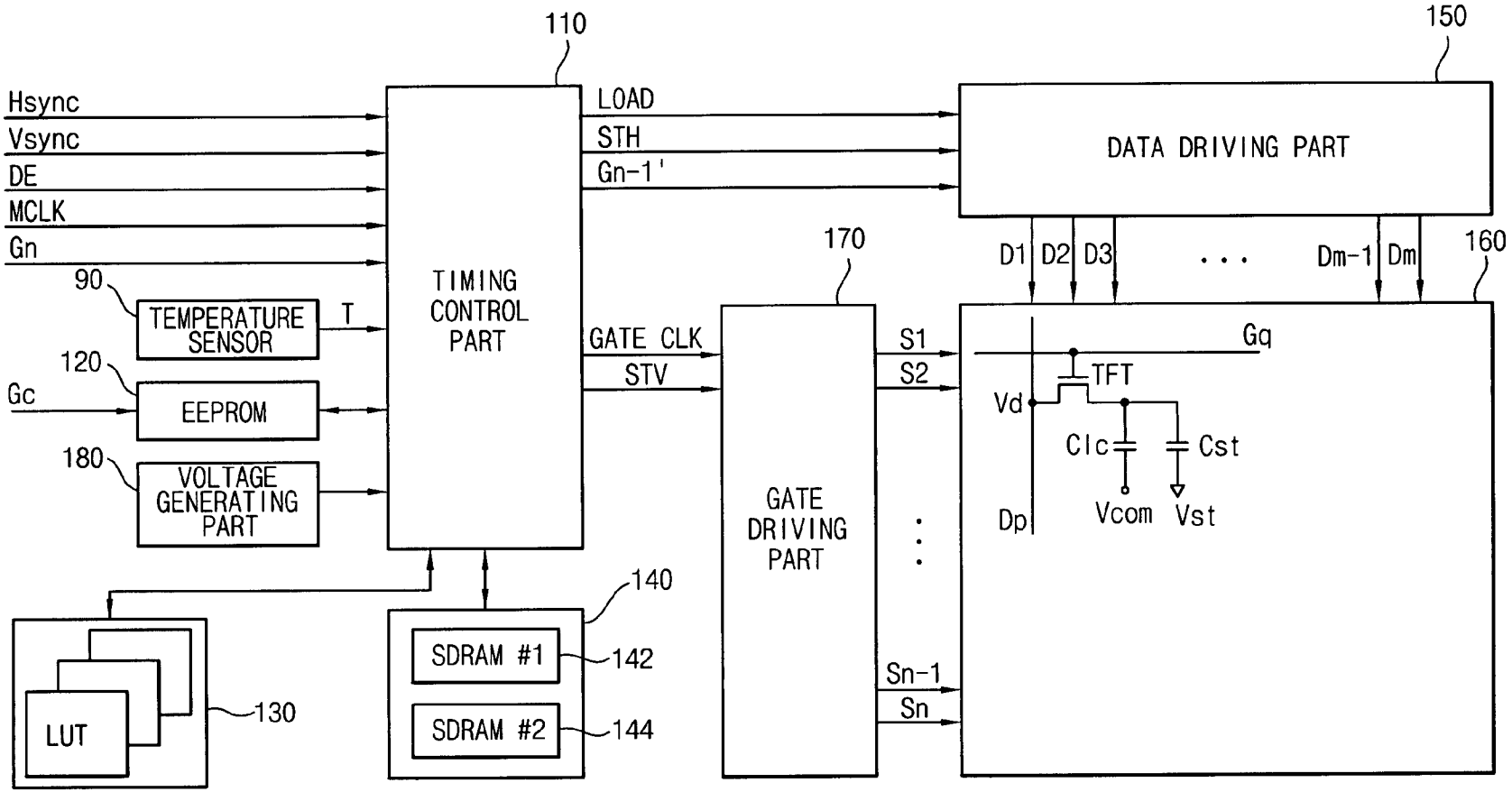
FIG. 5 is a block diagram showing a liquid crystal display (LCD) device in accordance with an exemplary embodiment of the present invention.

FIG. 5 is a block diagram showing a liquid crystal display (LCD) device in accordance with one exemplary embodiment of the present invention.

Referring to FIG. 5, the LCD device includes a temperature sensor 90, a timing control part 110, a first memory 120, a second memory 130, a third memory 140, a data driving part 150, an LCD panel 160, a gate driving part 170 and a voltage generating part 180. In FIG. 5, the first, second and third memories 120, 130 and 140 are separated from the timing control part 110. Alternatively, the first, second and third memories 120, 130 and 140 may be integrally formed with the timing control part 110.

The timing control part 110 receives a primary gray-scale data Gn of a present frame, synchronization signals Hsync and Vsync, a data enable signal DE and a main clock signal MCLK from an exterior to the timing control part 110. The timing control part 110 outputs compensation gray-scale data Gn-1' of a previous stage for increasing a response speed of liquid crystals, and data driving signals LOAD and STH for outputting the compensation gray-scale data Gn-1' of the previous stage to the data driving part 140. In addition, the timing control part 110 outputs gate driving signals GATE CLK and STV for outputting the compensation gray-scale data Gn-1' of the previous stage to the gate driving part 160.

In particular, when compensation gray-scale data Gc for increasing the response speed of the liquid crystal are applied to the timing control part 110 through the first memory 120, the timing control part 110 stores the compensation gray-scale data Gc in the second memory 130 as a LUT form.

The timing control part 110 also receives a temperature signal T from the temperature sensor 90 and a primary gray-scale data Gn of the present frame. The timing control part 110 outputs the compensation gray-scale data Gn-1' that is the data signal to the data driving part 140 based on the gray-scale data Gn of the present frame and the compensation gray-scale data Gn-1' of the previous frame to increase the response time of the liquid crystals.

The first memory 120 temporarily stores the compensation gray-scale data Gc for increasing the response speed of the liquid crystals, and outputs the compensation gray-scale data Gc to the timing control part 110 based on signals from the timing control part 110. In particular, the compensation gray-scale data Gc correspond to an amount of data compensation for compensating the temperature signal. When the temperature varies, the first memory 120 temporarily stores the compensation gray-scale data Gc corresponding to the temperature, and outputs the stored compensation gray-scale data Gc to the timing control part 110 based on the signals from the timing control part 110.

The second memory 130 stores the compensation gray-scale data Gc corresponding to gray-scale data of the present frame with respect to gray-scale data of the previous frame at various temperatures (or temperature ranges) as the LUT form. When full gray-scale data of the present frame and full gray-scale data of the previous frame are stored in the second memory 130, the size of the second memory 130 is increased. In the LCD device in FIG. 5, a portion of the full gray-scale data of the present frame corresponding to predetermined gray-scales and a portion of the full gray-scale data of the previous frame corresponding to the predetermined gray-scales are only stored in the second memory to decrease the size of the second memory 130. The remaining portion of the full gray-scale data of the present frame and the remaining portion of the full gray-scale data of the previous frame are calculated through the interpolation algorithm shown in FIGS. 1 to 4.

The third memory 140 stores the primary gray-scale data that are from an exterior to the third memory 140. In particular, the third memory 140 includes a first memory bank 142 and a second memory bank 144. When a half of the primary gray-scale data of the present frame is stored in the first memory bank 142, the second memory bank 144 outputs a remaining half of the primary gray-scale data of the present frame. Alternatively, when the first memory bank 142 outputs the half of the primary gray-scale data of the present frame, the remaining half of the primary gray-scale data of the present frame is stored in the second memory bank 144. The third memory 140 includes the first and second memory banks 142 and 144 to simultaneously read and write the primary gray-scale data.

The data driving part 150 receives the compensation gray-scale data Gn-1' of the previous frame from the timing control part 110 to convert the compensation gray-scale data Gn-1' into gray-scale voltages that are data voltages or data signals D1, D2, . . . Dm. The data driving part 150 outputs the converted gray-scale voltages that are the data signals D1, D2, . . . Dm to the LCD panel 160.

The LCD panel 160 includes an array substrate, a color filter substrate and a liquid crystal layer to display images. The color filter substrate is combined with the array substrate so that the liquid crystal layer is interposed between the array substrate and the color filter substrate. The LCD panel 160 includes a plurality of gate lines that are scan lines and a plurality of data lines that are source lines. The data lines transmit the data signals D1, D2, . . . Dm, and the gate lines transmit the gate signals. Pixels are defined by adjacent gate and data lines. A thin film transistor TFT, a liquid crystal capacitor Clc and a storage capacitor Cst are on each of the pixels. A source electrode of the TFT is electrically connected to one of the source lines, and a gate electrode of the TFT is electrically connected to one of the gate lines. A drain electrode of the TFT is electrically connected to the liquid crystal capacitor Clc.

The gate driving part 170 applies the gate signals S1, S2, . . . Sn to the gate lines based on the gate driving signals GATE CLK, STV to turn on the TFTs.

The voltage generating part 180 applies a voltage to the timing control part 110. The voltage generating part 180 controls an application of the voltage to decrease an error that may be formed during writing of the LUT storing the compensation gray-scale data in the first memory 120. The first memory 120 is, for example, an electrical erasable programmable read only memory (EEPROM).

The timing control part 110, the first, second and third memories 120, 130 and 140, the data driving part 150 and the gate driving part 170 form a driving apparatus for the LCD device. Alternatively, the timing control part 110, the first, second and third memories 120, 130 and 140, the data driving part 150 and the gate driving part 170 may be integrally formed to form the driving apparatus for the LCD device.

The LCD device of FIG. 5 receives digital signals from an outside of the LCD device. Alternatively, the LCD device may receive analog signals.

In FIG. 5, the LCD device receives the primary gray-scale data and the compensation gray-scale data that are compensated by the temperature. Alternatively, the LCD device may only receive the primary gray-scale data, and the primary gray-scale data may be directly compensated by the LCD device having an internal temperature sensor. The LCD device may have a plurality of LUTs including the compensation gray-scale data corresponding to the temperature ranges, and one of the LUTs is selected based on the sensed temperature to compensate the gray-scale data, thereby increasing the response speed of the liquid crystals.

Figure 6:
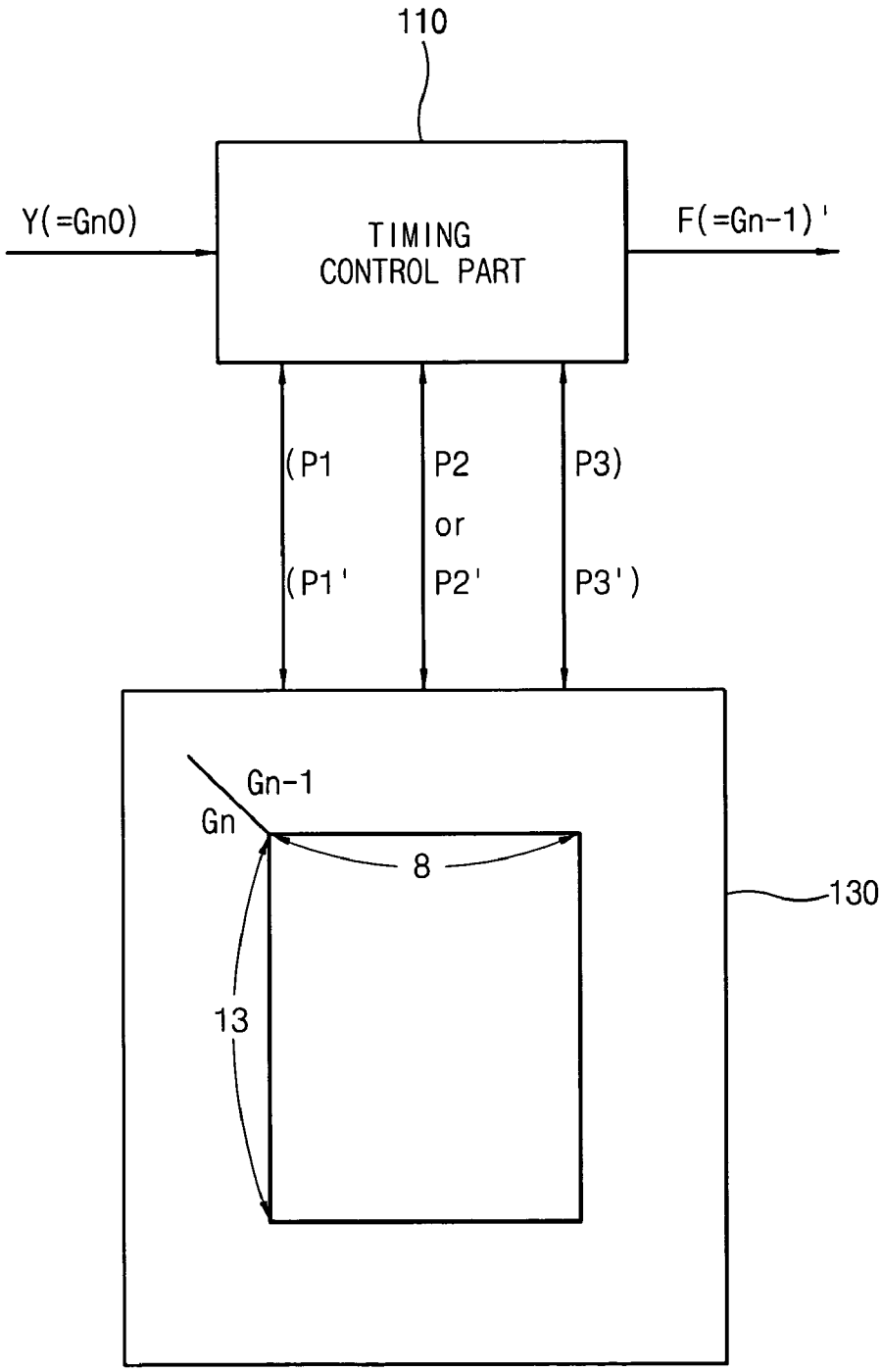
FIG. 6 is a block diagram showing a timing control part and a second memory shown in FIG. 5.

FIG. 6 is a block diagram showing a timing control part and a second memory shown in FIG. 5.

Referring to FIGS. 5 and 6, the timing control part 110 receives the gray-scale data Gn of the present frame, and extracts the compensation gray-scale data Gn-1' (or F) based on the stored gray-scale data Gn-1 of the previous frame and the gray-scale data Gn of the present frame. The extracted compensation gray-scale data Gn-1' is applied to the data driving part 140.

When the gray-scale data Gn-1 of the previous frame and the gray-scale data Gn of the present frame are in the LUT, the timing control part 110 extracts compensation gray-scale data that are mapped by the gray-scale data Gn-1 of the previous frame and the gray-scale data Gn of the present frame, and the extracted compensation gray-scale data is applied to the data driving part 140.

When the gray-scale data Gn-1 of the previous frame and the gray-scale data Gn of the present frame are not in the LUT, the timing control part 110 interpolates the compensation gray-scale data Gn-1' corresponding to the gray-scale data Gn-1 of the previous frame and the gray-scale data Gn of the present frame, and the interpolated compensation gray-scale data Gn-1' is applied to the data driving part 140. In particular, a column component of the compensation gray-scale data Gn-1' is interpolated based on coefficients p1, p2 and p3, or p1', p2' and p3' that are extracted from the LUT through a quadratic interpolation, and the row component of the compensation gray-scale data Gn-1' is interpolated through a linear interpolation. The interpolated compensation gray-scale data Gn-1' that are interpolated through the quadratic interpolation and the linear interpolation is applied to the data driving part 140. The quadratic interpolation and the linear interpolation are the same as in FIGS. 1 to 4. Thus, any further explanation concerning the above elements will be omitted since such interpolation methods have been previously described above.

In FIG. 6, an exemplary size of the LUT stored in the second memory 130 is 8*13 (which is smaller than 16*16). It will be appreciated that the size of the LUT may be changed.

The second memory 130 may be integrally formed with the timing control part 110. Alternatively, the second memory 130 may be spaced apart from the timing control part 110.

Figure 7:
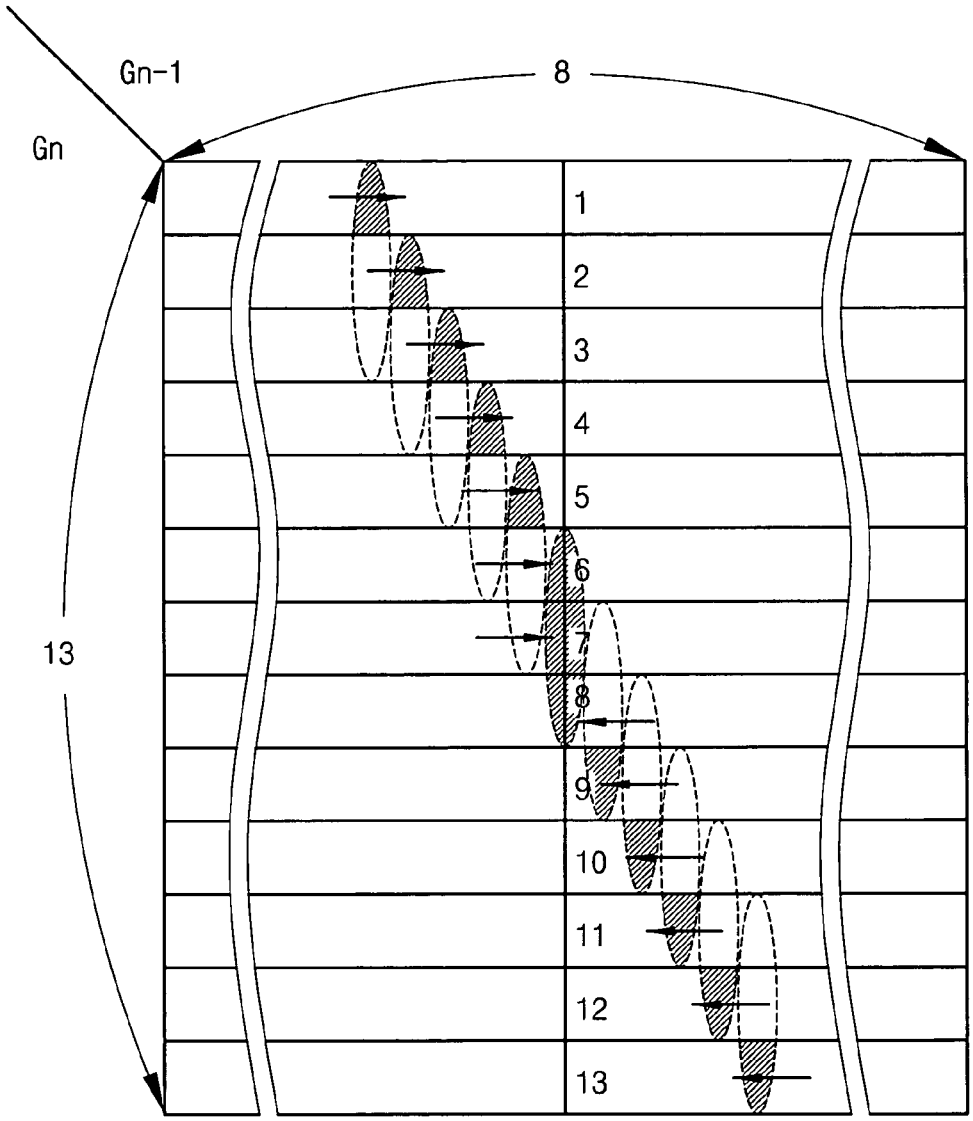
FIG. 7 is a block diagram showing operation of the second memory shown in FIG. 6.

FIG. 7 is a block diagram showing an operation of the second memory shown in FIG. 6.

Referring to FIG. 7, the LUT has, for example, thirteen parameter regions that are position data in the column direction. Adjacent three parameter regions are grouped into one loop so that the LUT has eleven loops. Adjacent loops share two parameter regions. First parameter regions of each of first, second, third, fourth and fifth loops and last parameter regions of each of seventh, eighth, ninth, tenth and eleventh loops are interpolation regions, respectively. In addition, first, second and last parameter regions of a sixth loop are also interpolation regions, respectively.

Figure 8:
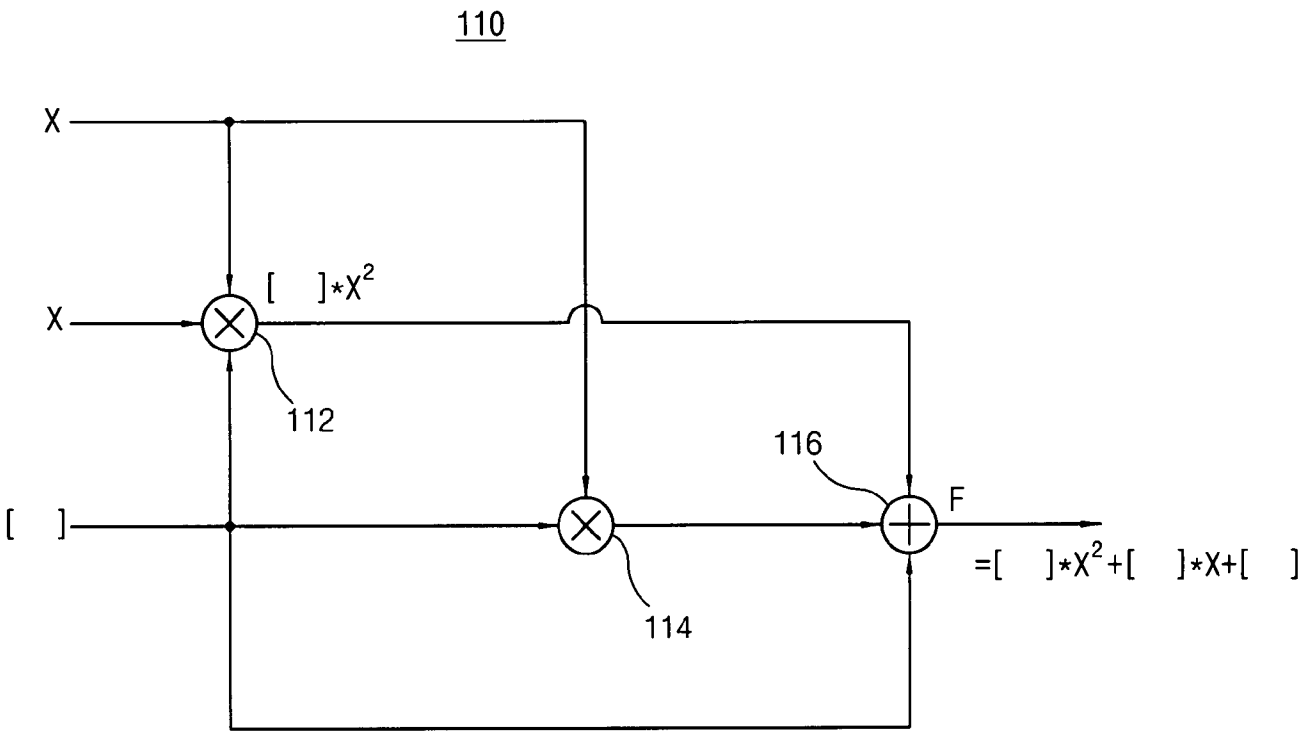
FIG. 8 is a block diagram showing operation of the timing control part shown in FIG. 6.

FIG. 8 is a block diagram showing an operation of the timing control part shown in FIG. 6. When the gray-scale data Gn-1 of the previous frame and the gray-scale data Gn of the present frame are not in the LUT, the column component and the row component of the compensation gray-scale data are interpolated to output the interpolated compensation gray-scale data to the data driving part 140.

Referring to FIG. 8, the timing control part 110 includes a first multiplying part 112, a second multiplying part 114 and an adding part 116 to output gray-scale data that are not stored in the LUT to the data driving part 140 as an objective gray-scale data.

The first multiplying part 112 outputs a first multiplied value that is a square of X multiplied by calculated value [ ] to the second multiplying part 114 and the adding part 116. The calculated value [ ] is calculated during a loading of the LCD device. X and the calculated value [ ] represent a column component with respect to a first interpolation value $f_A$ and a coefficient of Equation 22. That is, the calculated value [ ] is $$\left[\left(1-\frac{\Delta y}{\Delta}\right)p1+\frac{\Delta y}{\Delta}p1'\right],\ \left[\left(1-\frac{\Delta y}{\Delta}\right)p2+\frac{\Delta y}{\Delta}p2'\right]\text{ or }\left[\left(1-\frac{\Delta y}{\Delta}\right)p3+\frac{\Delta y}{\Delta}p3'\right],$$

wherein Δy and Δ represent a difference between the first interpolation value $f_A$ in a row direction and the objective interpolation value, and the difference between gray-scales of a first column and gray-scales in a second column, respectively. In the above equation for the calculated value [ ], p1, p2 and p3 represent coefficients of the first column while p1', p2' and p3' represent coefficients of the second column.

The second multiplying part 114 outputs a second multiplied value that is X multiplied by calculated value [ ] to the adding part 116.

The adding part 116 adds the first multiplied value, the second multiplied value and the calculated value [ ] to output the objective interpolation value to the data driving part 140.

In accordance with the present invention, although the image signal of the previous frame and the image signal of the present frame are not in the LUT, the column and row components of the compensation gray-scale data are interpolated via the quadratic equation and the linear equation, respectively, thereby decreasing the size of the required memory and improving overall accuracy.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A device for generating an objective interpolation value from a look up table including a plurality of position data that are stored in a plurality of regions defined by a plurality of rows and a plurality of columns, the device comprising:

a first multiplying part that multiplies a square value of a column component of the objective interpolation value by an operating value to generate a first multiplied value, the operating value being $$\left[\left(1-\frac{\Delta y}{\Delta}\right)p1+\frac{\Delta y}{\Delta}p1'\right],\ \left[\left(1-\frac{\Delta y}{\Delta}\right)p2+\frac{\Delta y}{\Delta}p2'\right]\text{ or }\left[\left(1-\frac{\Delta y}{\Delta}\right)p3+\frac{\Delta y}{\Delta}p3'\right],$$

wherein Δy and Δ represent a difference between a first interpolation value of a first row and the objective interpolation value and a distance between gray-scales of a first column and a second column, respectively, p1, p2 and p3 represent coefficients corresponding to the first column, and p1', p2' and p3' represent coefficients corresponding to the second column;

a second multiplying part that multiplies the column component by the operating value to generate a second multiplied value; and an adding part that sums up the first multiplied value, the second multiplied value and the operating value so as to generate the objective interpolation value.

2. An interpolation method for generating an objective interpolation value in a look up table including a plurality of position data that are stored in a plurality of regions defined by a plurality of rows and a plurality of columns, the method comprising:

calculating a first interpolation value on a first line connecting at least three position data in one of the columns of the look up table;

calculating a second interpolation value on a second line connecting at least three position data in another column of the look up table, the second line being adjacent to the first line;

generating a difference value between a column component of the first line and a column component of the objective interpolation value;

dividing the difference value by a difference between gray-scale levels in adjacent columns to generate a division value;

multiplying a difference between the first and second interpolation values by the division value to generate a multiplied value; and adding the first interpolation value to the multiplied value to generate the objective interpolation value.

3. The method of claim 2, wherein the three position data on the first line are adjacent to each other.

4. The method of claim 2, wherein the three position data on the second line are adjacent to each other.

5. The method of claim 2, wherein the second interpolation value is greater than the first interpolation value.

6. The method of claim 2, wherein a plurality of image signals of a previous frame is mapped to the columns of the look up table, and a plurality of image signals of a present frame is mapped to the rows of the look up table.

7. The method of claim 2, wherein the interpolation method is associated with liquid crystals and the objective interpolation value comprises gray-scale data to increase a response speed of the liquid crystals, and the distance between the gray-scale levels in one of the columns is changed in accordance with physical characteristics of the liquid crystals.

8. The method of claim 2, wherein the distance between the column gray-scale levels is changed in response to an inclination of the column component.

9. The method of claim 2, wherein when an inclination of the column component is relatively steep, the distance between the gray-scale levels in one of the columns is decreased, and when the inclination of the column component is relatively small, the distance between the gray-scale levels in the one of the columns is increased.

10. The method of claim 2, wherein the number of the columns of the look up table is different from the number of the rows of the look up table.

11. The method of claim 2, wherein three position data in a first column and three position data of a second column are grouped into a first loop and a second loop, respectively, and the first interpolation value $f_A$ is derived by the following equation, $$f_A=p1(x0+\Delta x)^{2-}-p2(x0-\Delta X)+p3,$$

wherein x0 and Δx represent a first position data of the first loop and a difference between the first and second interpolation values, respectively, and p1, p2 and p3 represent coefficients of the first loop.

12. The method of claim 2, wherein three position data in a first column and three position data of a second column are grouped into a first loop and a second loop, respectively, and the second interpolation value $f_B$ is defined by the following equation, $$f_B=p1'(x0+\Delta x)^2+p2'(x0+\Delta x)+p3'$$

wherein x0 and Δx represent a second position data of the second loop and a difference between the first interpolation value and the objective interpolation value, respectively, and p1', p2' and p3' represent coefficients of the second loop.

13. A computer readable medium for performing an interpolation method to generate an objective interpolation value in a look up table including a plurality of position data that are stored in a plurality of regions defined by a plurality of rows and a plurality of columns, the computer readable medium comprising a program, and a method of processing the program comprising:

calculating a first interpolation value on a first line connecting at least three position data in one of the columns of the look up table;

calculating a second interpolation value on a second line connecting at least three position data in another column of the look up table, the second line being adjacent to the first line;

generating a difference value between a column component of the first line and a column component of the objective interpolation value;

dividing the difference value by a difference between gray-scale levels in adjacent columns to generate a division value;

multiplying a difference between the first and second interpolation values by the division value to generate a multiplied value; and adding the first interpolation value to the multiplied value to generate the objective interpolation value.

14. The computer readable medium of claim 13, wherein the three position data on the first line are adjacent to each other.

15. The computer readable medium of claim 13, wherein the three position data on the second line are adjacent to each other.

16. The computer readable medium of claim 13, wherein the second interpolation value is greater than the first interpolation value.

17. The computer readable medium of claim 13, wherein a plurality of image signals of a previous frame is mapped to the columns of the look up table, and a plurality of image signals of a present frame is mapped to the rows of the look up table.

18. The computer readable medium of claim 13, wherein the interpolation method is associated with liquid crystals and the objective interpolation value comprises gray-scale data to increase a response speed of the liquid crystals, and the distance between the gray-scale levels in one of the columns is changed in accordance with physical characteristics of the liquid crystals.

19. The computer readable medium of claim 13, wherein the distance between the column gray-scale levels is changed in response to an inclination of the column component.

20. The computer readable medium of claim 13, wherein when an inclination of the column component is relatively steep, the distance between the gray-scale levels in one of the columns is decreased, and when the inclination of the column component is relatively small, the distance between the gray-scale levels in one of the columns is increased.

21. The computer readable medium of claim 13, wherein the number of the columns of the look up table is different from the number of the rows of the look up table.

22. The computer readable medium of claim 13, wherein three position data in a first column and three position data of a second column are grouped into a first loop and a second loop, respectively, and the first interpolation value $f_A$ is derived by the following equation, $$f_A=p1(x0+\Delta x)^{2-}-p2(x0-\Delta x)+p3,$$

wherein x0 and Δx represent a first position data of the first loop and a difference between the first and second interpolation values, respectively, and p1, p2 and p3 represent coefficients of the first loop.

23. The computer readable medium of claim 13, wherein three position data in a first column and three position data of a second column are grouped into a first loop and a second loop, respectively, and the second interpolation value $f_B$ is defined by the following equation, $$f_B=p1'(x0+\Delta x)^2+p2'(x0+\Delta x)+p3'$$

wherein x0 and Δx represent a second position data of the second loop and a difference between the first interpolation value and the objective interpolation value, respectively, and p1', p2' and p3' represent coefficients of the second loop.

24. A device for generating an objective interpolation value from a look up table including a plurality of position data that are stored in a plurality of regions defined by a plurality of rows and a plurality of columns, the device comprising:

an operating part to calculate a first interpolation value on a first line connecting at least three position data in one of the columns of the look up table and a second interpolation value on a second line connecting at least three position data in another column of the look up table, the second line being adjacent to the first line;

a subtracting part that generates a difference value between a column component of the first line and a column component of the objective interpolation value;

a dividing part dividing the difference value by a difference between gray-scale levels in adjacent columns to generate a division value;

a multiplying part that multiplies a difference between the first and second interpolation values by the division value to generate a multiplied value; and an adding part that adds the first interpolation value to the multiplied value so as to generate the objective interpolation value.

25. The device of claim 24, wherein the three position data on the first line are adjacent to each other.

26. The device of claim 24, wherein the three position data on the second line are adjacent to each other.

27. The device of claim 24, wherein the second interpolation value is greater than the first interpolation value.

28. The device of claim 24, wherein a plurality of image signals of a previous frame is mapped to the columns of the look up table, and a plurality of image signals of a present frame is mapped to the rows of the look up table.

29. The device of claim 24, wherein the interpolation method is associated with liquid crystals and the objective interpolation value comprises gray-scale data to increase a response speed of the liquid crystals, and the distance between the gray-scale levels in one of the columns is changed in accordance with physical characteristics of the liquid crystals.

30. The device of claim 24, wherein the distance between the column gray-scale levels is changed in response to an inclination of the column component.

31. The device of claim 24, wherein when an inclination of the column component is relatively steep, the distance between the gray-scale levels in one of the columns is decreased, and when the inclination of the column component relatively small, the distance between the gray-scale levels in the one of the columns is increased.

32. The device of claim 24, wherein the number of the columns of the look up table is different from the number of the rows of the look up table.

33. The device of claim 24, wherein three position data in a first column and three position data of a second column are grouped into a first loop and a second loop, respectively, and the first interpolation value $f_A$ is derived by the following equation, $$f_A=p1(x0+\Delta x)^{2-}-p2(x0-\Delta x)+p3,$$

wherein x0 and Δx represent a first position data of the first loop and a difference between the first and second interpolation values, respectively, and p1, p2 and p3 represent coefficients of the first loop.

34. The device of claim 24, wherein three position data in a first column and three position data of a second column are grouped into a first loop and a second loop, respectively, and the second interpolation value $f_B$ is defined by the following equation, $$f_B=p1'(x0+\Delta x)^2+p2'(x0+\Delta x)+p3'$$

wherein x0 and Δx represent a second position data of the second loop and a difference between the first interpolation value and the objective interpolation value, respectively, and p1', p2' and p3' represent coefficients of the second loop.

* * * * *